US008807316B2

(12) United States Patent
Li et al.

(10) Patent No.: US 8,807,316 B2
(45) Date of Patent: Aug. 19, 2014

(54) BANKNOTE PROCESSING SYSTEM AND METHOD

(75) Inventors: Yedong Li, Guangzhou (CN); Zhiqiang Sun, Guangzhuo (CN); Yanwen Ha, Guangzhou (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 13/810,436

(22) PCT Filed: Nov. 10, 2011

(86) PCT No.: PCT/CN2011/082018

§ 371 (c)(1),
(2), (4) Date: Jan. 15, 2013

(87) PCT Pub. No.: WO2012/079437

PCT Pub. Date: Jun. 21, 2012

(65) Prior Publication Data

US 2013/0118861 A1 May 16, 2013

(30) Foreign Application Priority Data

Dec. 17, 2010 (CN) ..... 2010 1 0593971

(51) Int. Cl.
*G07F 7/04* (2006.01)

(52) U.S. Cl.
USPC ..... 194/206; 194/215; 902/12

(58) Field of Classification Search
USPC ..... 194/206, 207, 215, 216; 209/534
See application file for complete search history.

(56) References Cited

U.S. PATENT DOCUMENTS

| | | | | |
|---|---|---|---|---|
| 8,240,450 | B2 * | 8/2012 | Brexel et al. | 194/206 |
| 8,276,733 | B2 * | 10/2012 | Watanabe | 194/206 |
| 2002/0107800 | A1 * | 8/2002 | Kadowaki et al. | 705/43 |
| 2003/0121077 | A1 * | 6/2003 | Katou et al. | 902/12 |

(Continued)

FOREIGN PATENT DOCUMENTS

| | | | |
|---|---|---|---|
| CN | 1361495 | A | 7/2002 |
| CN | 1462985 | A | 12/2003 |

(Continued)

OTHER PUBLICATIONS

International Search Report dated Feb. 9, 2012 from corresponding International Application No. PCT/CN2011/082018.

*Primary Examiner* — Jeffrey Shapiro
(74) *Attorney, Agent, or Firm* — Wolf, Greenfield & Sacks, P.C.

(57) ABSTRACT

Disclosed are a banknote processing system and method. The system comprises: a terminal (1), an identification unit (2), a physical banknote box (4), a banknote box information storage unit (5), and a main control unit (3). The identification unit (2) detects the banknotes getting in or out of the physical banknote box (4) to obtain inherent information of the banknotes; the main control unit (3) updates a virtual electronic banknote box according to the inherent information of the banknotes, and determine information of the banknotes in the physical banknote box (4) according to the information of the virtual electronic banknote box. The virtual electronic banknote box is a set of the inherent information of the banknotes, wherein the inherent information of the virtual electronic banknote box is one-to-one mapped to the banknotes in the physical banknote box (4), and the storage sequence of the inherent information is the same as the placement sequence of the banknotes in the physical banknote box (4).

14 Claims, 5 Drawing Sheets

(56) References Cited

U.S. PATENT DOCUMENTS

| | | | | |
|---|---|---|---|---|
| 2004/0015439 | A1* | 1/2004 | Taniyama | 705/40 |
| 2004/0182678 | A1* | 9/2004 | Ina et al. | 194/207 |
| 2004/0245066 | A1* | 12/2004 | Ichikawa et al. | 194/206 |
| 2004/0260650 | A1* | 12/2004 | Nagaya et al. | 705/43 |
| 2005/0010525 | A1* | 1/2005 | Ross et al. | 705/43 |
| 2005/0150740 | A1* | 7/2005 | Finkenzeller et al. | 194/207 |
| 2006/0043167 | A1* | 3/2006 | Fujioka | 235/379 |
| 2008/0106726 | A1* | 5/2008 | Park | 356/71 |
| 2008/0197972 | A1* | 8/2008 | Lawson et al. | 340/5.86 |
| 2009/0229947 | A1* | 9/2009 | Takai et al. | 194/206 |
| 2010/0000838 | A1* | 1/2010 | Hamasaki | 194/207 |
| 2010/0174402 | A1* | 7/2010 | Hattori et al. | 700/215 |
| 2011/0068169 | A1* | 3/2011 | Ross et al. | 235/379 |

FOREIGN PATENT DOCUMENTS

| | | | |
|---|---|---|---|
| CN | 1469326 | A | 1/2004 |
| CN | 1573829 | A | 2/2005 |
| CN | 101533537 | A | 9/2009 |
| CN | 102013128 | A | 4/2011 |
| JP | 11224362 | A | 8/1999 |

* cited by examiner

BANKNOTE PROCESSING SYSTEM AND METHOD

This application is the U.S. National Phase of International Application No. PCT/CN2011/082018 filed on Nov. 10, 2011, and claims the priority of Chinese Patent Application No. 201010593971.3, entitled "BANKNOTE PROCESSING SYSTEM AND METHOD", filed with the Chinese Patent Office on Dec. 17, 2010, which applications are hereby incorporated by reference in their entirety.

FIELD OF THE INVENTION

The present invention relates to the field of computer technology, and in particular to a banknote processing system and method.

BACKGROUND OF THE INVENTION

An ATM (Automatic Teller Machine) has been widely used in various commercial banks and for postal saving. The ATM operates in the 24-hour self-help manner, which brings people great convenience.

In an ATM automatic banknote adding system, all of cash recycling ATMs, cash deposit ATMs and banknote adding machines share a same kind of banknote boxes. The banknote box itself has an information memory for storing information on banknotes in the banknote box. Each banknote box has a physical ID number which is globally unique, so as to be able to distinguish from each other. The automatic banknote adding system may directly transmit a banknote box which is full of banknotes in a cash deposit ATM to a cash outputting ATM, and the cash outputting ATM automatically gets the information on the banknote in the banknote box, so as to automatically add banknotes. The banknote box may be changed at any moment at will between all banknote processing machines in the automatic banknote adding system, and information on each replacing banknote box is uploaded to a server of a bank through each ATM so as to record corresponding data, thus no man-made count is needed, so that the efficiency of processing banknote is greatly improved.

Presently, if an ATM is used for cash withdrawal, the ATM may send unqualified banknotes to a recovery part. However, information (including the number and face values of the banknotes) on the banknotes sent to the recovery part cannot be correctly determined. Therefore, it is impossible to accurately obtain the information on the residual banknotes in the banknote box.

For example, if a certain banknote is in an unqualified status such as an overlapped banknote or an adhesion banknote) when the banknote is output from a cash recycling ATM, it can be determined that the banknote is in the abnormal status by measuring the thickness or width, and thus the banknote is recovered. However, it is very difficult to determine the number of the recovered banknotes (taking the overlapped banknotes as an example, it is impossible to determine whether three or two banknotes are overlapped; and if there is adhesive substance on one banknote, the banknote may also be mistakenly determined as two banknotes). Therefore, it is unable to accurately track the information on the residual banknotes in the banknote box. To accurately obtain the information on banknotes in the banknote box is an important prerequisite for the ATM to automatically add banknotes.

SUMMARY OF THE INVENTION

The technical problem to be solved by the present invention is to provide a banknote processing system and method, which may ensure the accurate flow of the banknotes in the banknote box and guarantee the information on the banknotes in the banknote box to be accurate.

In order to solve the above technical problem, the embodiment of the present invention provides a banknote processing method, including the steps of:

S1: detecting a banknote which is input into or output from a physical banknote box to obtain inherent information on the banknote; and updating a virtual electronic banknote box according to the inherent information on the banknote;

wherein the inherent information is identification information for distinguishing various banknotes; the virtual electronic banknote box is an aggregate of the inherent information on banknotes, the inherent information in the virtual electronic banknote box and the banknotes in the physical banknote box have one-to-one mapping relationship with each other, and the storage order of the inherent information and the stacking order of the banknotes in the physical banknote box are the same; and

S2: determining information on the banknote in the physical banknote box according to the information in the virtual electronic banknote box.

Correspondingly, the embodiment of the present invention also provides a banknote processing system, including a terminal machine, an identification unit, a physical banknote box, a banknote box information memory and a main control unit.

The terminal machine is configured to deal with cash deposit transaction and/or cash withdrawal transaction.

The identification unit is configured to, during cash deposit or withdrawal via the terminal machine, detect a banknote which is input into or output from the physical banknote box to get inherent information on the banknote. The inherent information is identification information for distinguishing various banknotes.

The main control unit is configured to update the virtual electronic banknote box according to the inherent information on the banknote obtained by the identification unit; and to determine information on the banknotes in the physical banknote box according to the information in the virtual electronic banknote box. The virtual electronic banknote box is an aggregate of the inherent information on banknotes. The inherent information in the virtual electronic banknote box and the banknotes in the physical banknote box have one-to-one mapping relationship with each other, and the storage order of the inherent information and the stacking order of the banknotes in the physical banknote box are the same.

The physical banknote box is configured to store banknotes.

Both the physical banknote box and the virtual electronic banknote box are in a first-in last-out stack mode. A primary pointer and a secondary pointer are used to track the inherent information in the virtual electronic banknote box; and during initialization, the primary pointer and the secondary pointer point to the stack top of the virtual electronic banknote box.

The physical banknote box itself has a banknote box information memory for storing a virtual electronic banknote box and a banknote box information table. The banknote box information table includes information on attribute of the physical banknote box, the number of the banknotes and face values of the banknotes.

In the banknote processing system and method provided by the embodiments of the present invention, the virtual electronic banknote box which has one-to-one mapping relationship with the banknotes in the physical banknote box is established. When a banknote is input into or output from the physical banknote box, the inherent information in the virtual electronic banknote box is synchronously updated. Thus, the information on the banknotes in the physical banknote box may be determined from the information in the virtual electronic banknote box. Therefore, the accurate flow of the banknotes in the physical banknote box is ensured, the information on the banknotes in the physical banknote box may be guaranteed to be accurate, which may provide accurate banknote box information to the automatic banknote adding system.

DETAILED DESCRIPTION OF THE INVENTION

The technical solutions in the embodiments of the present invention will be described clearly and completely in conjunction with the drawings accompanying with the embodiments of the present invention as follows. It is apparent that the described embodiments are only a part of and not all of embodiments of the present invention. All of other embodiments obtained by the skilled in the art based on the embodiments in the present invention without any creative work are belong to the scope of protection of the present invention.

Figure 1:
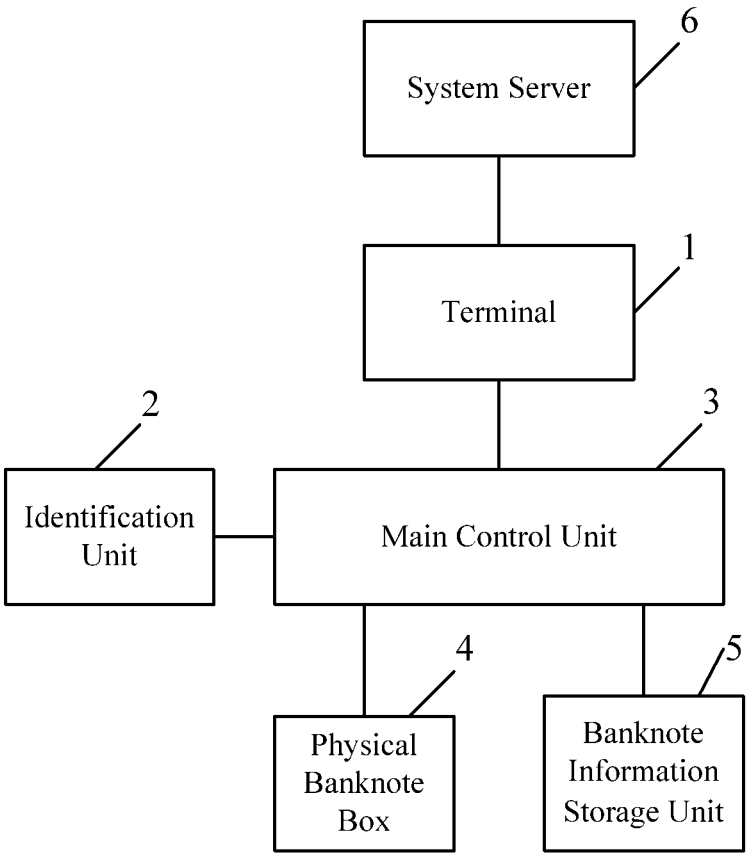
FIG. 1 is a schematic view of the structure of a banknote processing system according to an embodiment of the present invention.

Reference is made to FIG. 1, which is a schematic view of the structure of a banknote processing system according to an embodiment of the present invention.

The banknote processing system according to the embodiment includes a terminal machine 1, an identification unit 2, a main control unit 3, a physical banknote box 4 and a banknote box information memory 5.

The terminal machine 1 is configured to deal with cash deposit transaction and/or cash withdrawal transaction.

The identification unit 2 is configured to, during cash deposit or withdrawal via the terminal machine 1, detect a banknote which is input into or output from the physical banknote box 4 so as to get inherent information on the banknote. The inherent information is identification information for distinguishing various banknotes. The inherent information about banknotes may be a banknote serial number or other information that may distinguish a certain banknote from other banknotes.

The physical banknote box 4 is configured to store banknotes.

The banknote box information memory 5 is configured to store a virtual electronic banknote box being an aggregate of banknote inherent information. The inherent information in the virtual electronic banknote box and the banknotes in the physical banknote box have one-to-one mapping relationship with each other, and the storage order of the inherent information and the stacking order of the banknotes in the physical banknote box are the same.

The main control unit 3 is configured to update the virtual electronic banknote box according to the banknote inherent information obtained by the identification unit 2; and to determine the information on the banknotes in the physical banknote box 4 according to the information in the virtual electronic banknote box.

The banknote box information memory 5 is a memory owned by the physical banknote box 4. Besides the use of storing the virtual electronic banknote box, the banknote box information memory 5 is also configured to store a banknote box information table which includes information on attribute of the physical banknote box, the number of the banknotes and face values of the banknotes.

Both the physical banknote box and the virtual electronic banknote box are in a first-in last-out stack mode. The main control unit uses a primary pointer and a secondary pointer to track the inherent information in the virtual electronic banknote box. During initialization, the primary pointer and the secondary pointer point to the stack top of the virtual electronic banknote box.

Further, the identification unit 2 is also configured to verify whether a banknote to be input into the physical banknote box 4 is qualified or not, and to transmit a verification result to the main control unit 3. In a specific implementation, the identification unit 2 may be mounted in a transport channel to detect banknotes in the transport channel. The transport channel is a path through which a banknote passing in or out from the physical banknote box 4 has to pass.

Figure 2:
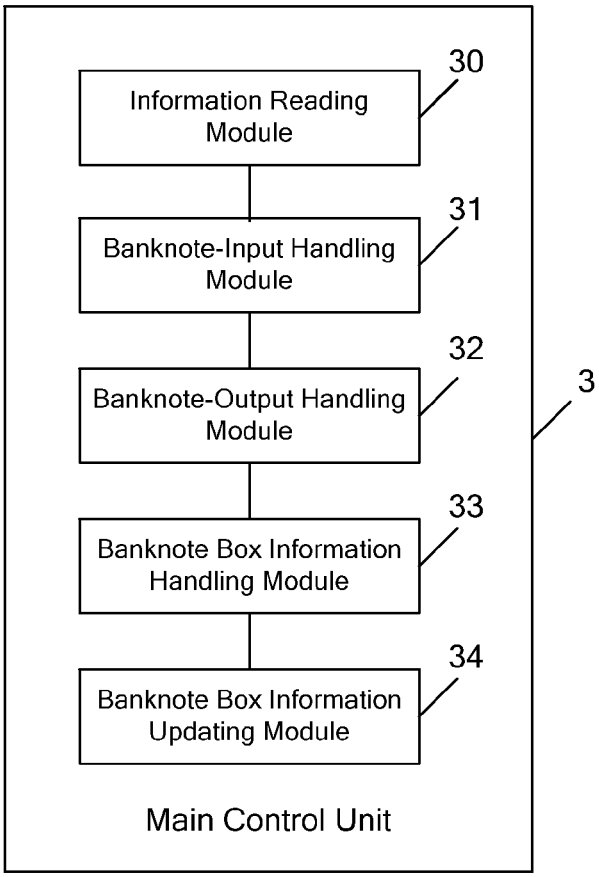
FIG. 2 is a schematic view of the structure of a main control unit according to an embodiment of the present invention.

As shown in FIG. 2, the main control unit 3 includes an information reading module 30, a banknote-input processing module 31, a banknote-output processing module 32, a banknote box information processing module 33 and a banknote box information updating module 34.

The information reading module 30 is configured to read the virtual electronic banknote box and the banknote box information table from the banknote box information memory 5.

If it is determined from the verification result that a banknote to be going into the physical banknote box is qualified, the banknote-input processing module 31 stores the banknote into the physical banknote box 4, and stores sequentially the inherent information on the banknote into the virtual electronic banknote box, and adds 1 to the primary pointer and the secondary pointer of the virtual electronic banknote box.

The banknote-output processing module 32 compares the inherent information on a banknote which is output from the physical banknote box 4 with the inherent information in the virtual electronic banknote box, so as to search for a mapped position of the banknote in the virtual electronic banknote box and to delete the inherent information at the mapped position.

The banknote box information processing module 33 is configured to determine the number of the banknotes in the physical banknote box 4 according to a position pointed by the primary pointer of the virtual electronic banknote box; and to determine the face values of the banknotes in the physical banknote box 4 according to the inherent information in the virtual electronic banknote box.

The banknote box information updating module 34 is configured to update, after the cash deposit or withdrawal ends, the information in the virtual electronic banknote box and the banknote box information table which are in the banknote box information memory 5.

Optionally, as shown in FIG. 1, the banknote processing system according to the embodiment further includes a system server 6. The main control unit 3 may also upload the virtual electronic banknote box and the banknote box information table to the terminal machine 1 and the system server 6, so that the deposit/withdrawal status of banknotes, the usage record of the banknote box and so on may be inquired via the terminal machine 1 and the system server 6. Thus the traceability of each banknote and each banknote box may be improved.

Hereinafter, the banknote processing method according to an embodiment of the present invention will be described in detail in conjunction with FIGS. 3 to 6. The banknote processing method may be applied to the banknote processing system in the above embodiment.

Figure 3:
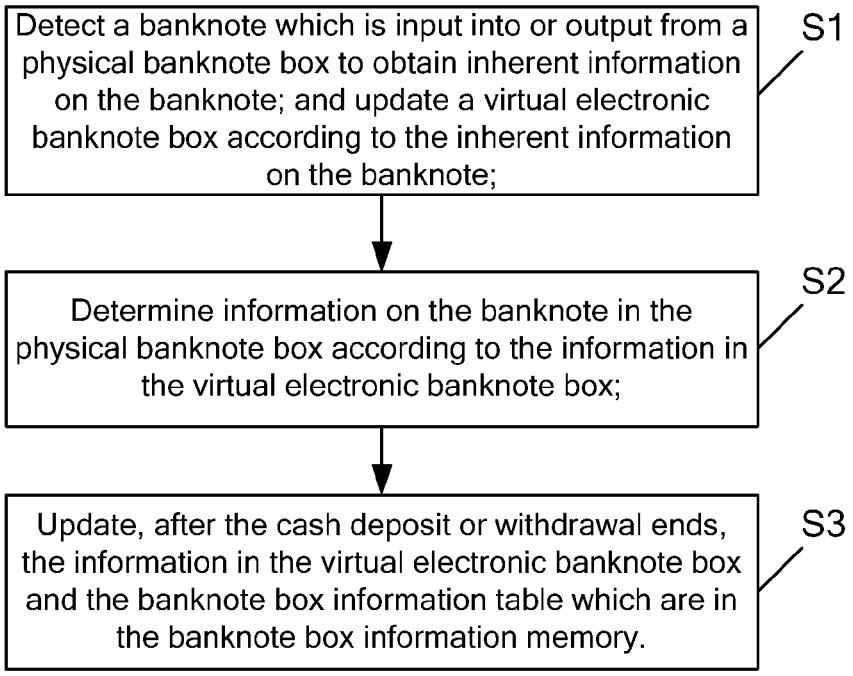
FIG. 3 is a schematic flowchart of a banknote processing method according to an embodiment of the present invention.

Reference is made to FIG. 3, which is a schematic flowchart of the banknote processing method according to the embodiment of the present invention.

The banknote processing method according to the embodiment includes the steps of:

S1: detecting a banknote which is input into or output from a physical banknote box to obtain inherent information on the banknote; and updating a virtual electronic banknote box according to the inherent information on the banknote; and S2: determining information on the banknote in the physical banknote box according to the information in the virtual electronic banknote box.

The inherent information is identification information for distinguishing various banknotes. The inherent information on banknotes may be a banknote serial number or other information that may distinguish a certain banknote from other banknotes.

Figure 4:
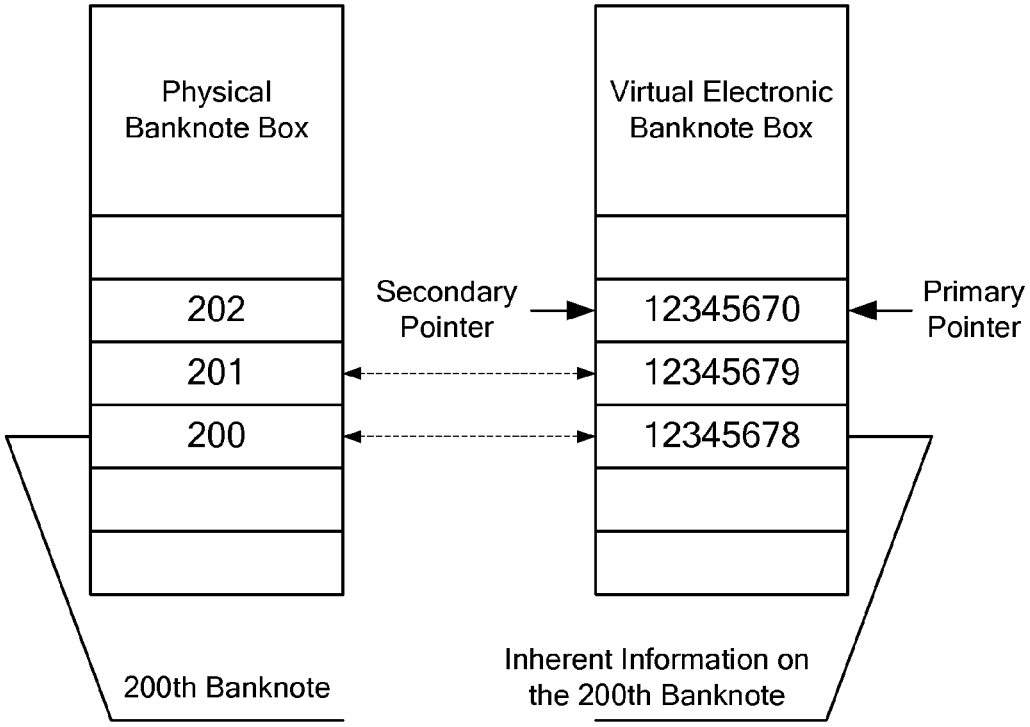
FIG. 4 is a schematic view of the structure of a virtual electronic banknote box according to an embodiment of the present invention.

Reference is made to FIG. 4, which is a schematic view of the structure of an embodiment of a virtual electronic banknote box according to the present invention.

In a specific implementation, the virtual electronic banknote box is stored in the banknote box information memory, and the banknote box information table is also stored in the banknote box information memory. The banknote box information table includes information on attribute of the physical banknote box, the number of the banknotes and face values of the banknotes.

The virtual electronic banknote box is an aggregate of banknote inherent information. The inherent information in the virtual electronic banknote box and the banknotes in the physical banknote box have one-to-one mapping relationship with each other, and the storage order of the inherent information and the stacking order of the banknotes in the physical banknote box are the same.

For example, as shown in FIG. 4, the serial numbers of the 200th, the 201st and the 202nd banknotes stacked in sequence in the physical banknote box are 12345678, 12345679 and 12345670, respectively. Then, in accordance with the stacking order of the above three banknotes, the serial numbers 12345678, 12345679 and 12345670 are stored in sequence in the virtual electronic banknote box so as to achieve the one-to-one mapping relationship between these serial numbers and the 200th, the 201st and the 202nd banknotes in the physical banknote box.

Both the physical banknote box and the virtual electronic banknote box are in a first-in last-out stack mode. The main control unit uses a primary pointer and a secondary pointer to track the inherent information in the virtual electronic banknote box, so as to accurately indicate the information on the banknotes in the physical banknote box. During initialization, the primary pointer and the secondary pointer point to the stack top of the virtual electronic banknote box. As shown in FIG. 4, the inherent information 12345670 is located at the stack top, and the inherent information which is stored in the first is located at the stack bottom.

In the banknote processing method according to the present embodiment, during cash deposit, every time one banknote is stored in the physical banknote box, the inherent information on this banknote is sequentially stored in the virtual electronic banknote box.

During the cash deposit, step S1 includes:

C0: reading, by the main control unit, the virtual electronic banknote box and the banknote box information table from the banknote box information memory;

C1: detecting, by the identification unit, a banknote to be input into the physical banknote box to obtain the inherent information on the banknote;

C2: the identification unit verifying whether the banknote is qualified or not, and sending a verification result to the main control unit; and C3: if it is determined by the main control unit from the verification result that the banknote is qualified, storing the banknote in the physical banknote box and storing sequentially the inherent information on the banknote into the virtual electronic banknote box, and adding 1 to the primary pointer and the secondary pointer.

For example, as shown in FIG. 4, during cash deposit, the 203rd banknote is stored in the physical banknote box and piled onto the 202nd banknote. At the same time, the inherent information 12345672 of the 203rd banknote is stored in the virtual electronic banknote box, and located on the inherent information 12345670 of the 202nd banknote. 1 is added to the primary pointer and the secondary pointer so that the pointers point to the inherent information 12345672.

During cash withdrawal, step S1 includes:

D0: reading, by the main control unit, the virtual electronic banknote box and the banknote box information table from the banknote box information memory;

D1: detecting, by the identification unit, a banknote which is output from the physical banknote box to obtain the inherent information on the banknote; and D2: comparing, by the main control unit, the inherent information on the banknote with the inherent information in the virtual electronic banknote box, so as to search for a mapped position of the banknote in the virtual electronic banknote box and to delete the inherent information at the mapped position.

More specifically, provided that the inherent information on the banknote obtained in step D1 is designated as parameter A1, and the inherent information currently pointed by the primary pointer of the virtual electronic banknote box is designated as parameter B1, D2 includes:

D21: judging whether parameter A1 is the same as parameter B1 or not;

if parameter A1 is the same as parameter B1, subtracting 1 from the primary pointer and the secondary pointer; deleting parameter B1, and setting the attribute of the physical banknote box to be a believable status; and if parameter A1 is not the same as parameter B1, subtracting 1 from the secondary pointer, and searching downwards towards the stack bottom of the virtual electronic banknote box for inherent information which is the same as parameter A1; and provided that inherent information pointed by the secondary pointer from which 1 has been subtracted is designated as parameter B2, performing step D22;

D22: judging whether parameter A1 is the same as parameter B2 or not;

if parameter A1 is the same as parameter B2, subtracting 2 from the primary pointer and subtracting 1 again from the secondary pointer, and setting the attribute of the physical banknote box to be an unbelievable status; and if parameter A1 is not the same as parameter B2, subtracting 1 again from the secondary pointer and continuously searching downwards for the inherent information which is the same as parameter A1;

D23: judging whether m, which is designated as the number of times 1 has been subtracted from the secondary pointer in order to search for the inherent information, is larger than a preset threshold of number of searching times or not;

if m is larger than the preset threshold of number of searching times, setting the attribute of the physical banknote box to be an unavailable status; and if m is not larger than the preset threshold of number of searching times, subtracting (m+1) from the primary pointer and subtracting 1 again from the secondary pointer, and setting the attribute of the physical banknote box to be an unbelievable status.

Furthermore, in step S2, the information on the banknotes in the physical banknote box includes the number of the banknotes and face values of the banknotes. Thus, step S2 includes: determining the number of the banknotes in the physical banknote box according to a position pointed by the primary pointer of the virtual electronic banknote box; and determining the face values of the banknotes in the physical banknote box according to the inherent information in the virtual electronic banknote box.

Furthermore, as shown in FIG. 3, after step S2, the method further includes:

S3: updating, after the cash deposit or withdrawal ends, the information in the virtual electronic banknote box and the banknote box information table which are in the banknote box information memory.

Besides the information on attribute of the physical banknote box, the number of the banknotes and face values of the banknotes, the banknote box information table according to the present embodiment also includes information writing time, device ID and MAC code.

The face value of banknote means the face value of each banknote stored in the physical banknote box.

The number of banknotes means the number of the banknotes stored in the physical banknote box.

The information writing time means the time when the banknote box information table is updated for the last time.

The device ID means the numbering of the host machine which updates the banknote box information table for the last time.

The MAC code is a check code generated from the attribute of the banknote box, the host machine key and the banknote box information table, and is used for other host machine to verify the validity of data in the banknote box information table.

The attribute of the physical banknote box is used to indicate the accuracy of information about the physical banknote box, and includes three statuses, i.e., a believable status, an unbelievable status and an unavailable status.

The believable status represents that the inherent information in the virtual electronic banknote box and the banknotes in the physical banknote box have one-to-one mapping relationship with each other, and the banknote box information is correct, that is, the physical banknote box may be provided into the automatic banknote adding system.

The unbelievable status represents that there is dislocation in mapping relationship between the virtual electronic banknote box and the physical banknote box, and correction of outputting the banknotes is needed. The physical banknote box in the unbelievable status may be automatically corrected by outputting the banknotes so as to be converted into the believable status.

The unavailable status represents that there is a severe error in the mapping relationship between the virtual electronic banknote box and the physical banknote box, and the automatic correction is not available, that is, a physical banknote box whose attribute is in the unavailable status cannot be provided into the automatic banknote adding system.

Moreover, either of the believable status and the unbelievable status may be transformed into the other. Both of these two statuses may be possibly transformed into the unavailable status. However, the unavailable status cannot be automatically transformed into the other two statuses.

The banknote processing method according to the embodiments of the present invention is applicable to the ATM system, the automatic banknote adding system and other systems in which the banknote processing is needed, which may ensure the accurate flow of the banknotes in the physical banknote box and may guarantee the information on the banknotes in the physical banknote box to be accurate. Hereinafter, the cash deposit processing process and the cash withdrawal processing process of the embodiments of the present invention are described in detail in conjunction with FIGS. 5 and 6.

Figure 5:
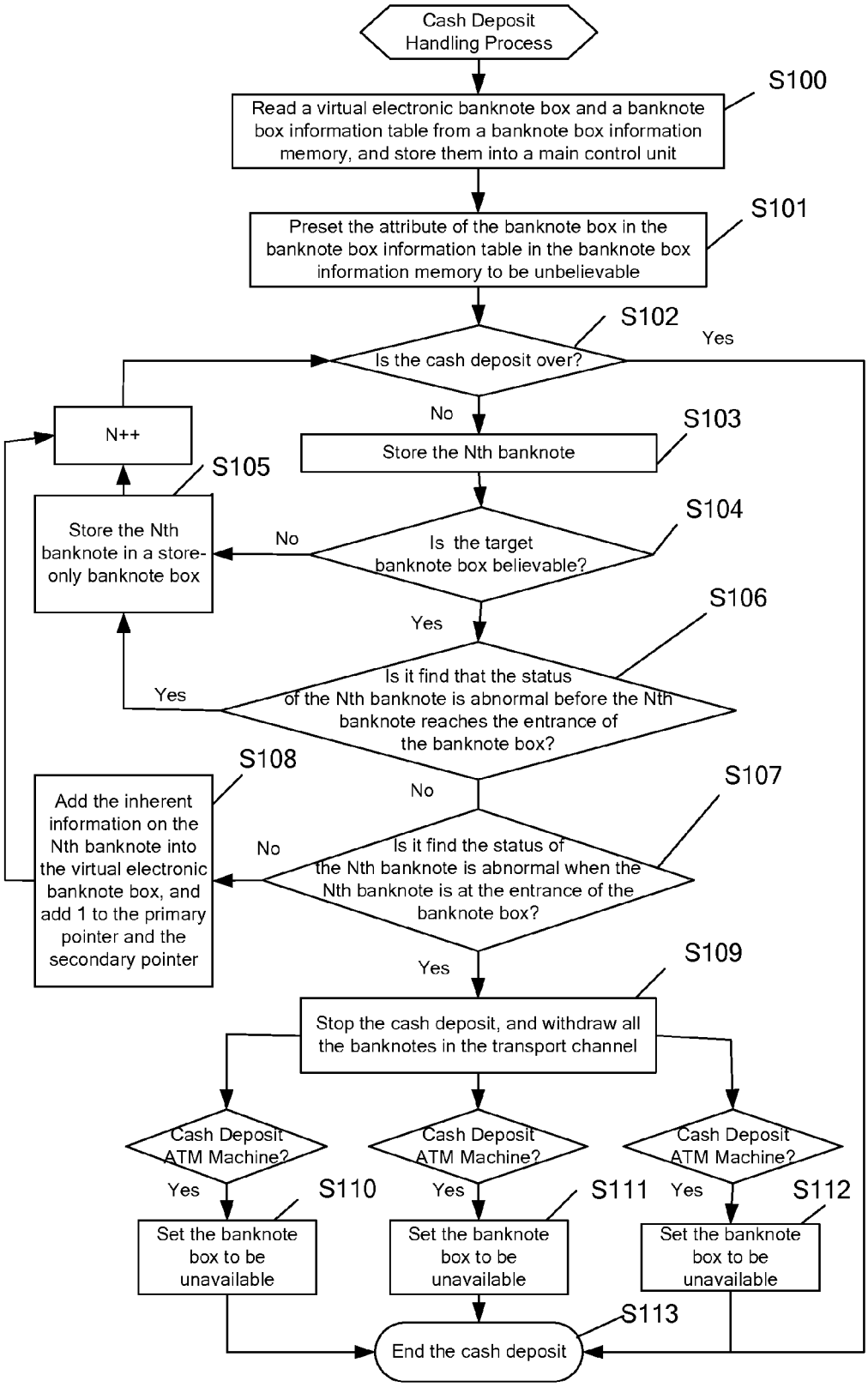
FIG. 5 is a schematic flowchart of a cash deposit processing process according to an embodiment of the present invention.

Reference is made to FIG. 5, which is a schematic flowchart of a cash deposit processing process according to an embodiment of the present invention.

During the cash deposit, a virtual electronic banknote box is established and a banknote box information table is updated. In an abnormal situation, special processing is performed, so as to ensure the accuracy of the virtual electronic banknote box and the banknote box information table of the banknote box during the cash deposit. If there is a malfunction or an abnormal status and the accuracy of information cannot be guaranteed, the attribute of the banknote box in the banknote box information table is set to be an unbelievable status or an unavailable status in time.

As shown in FIG. 5, the specific implementation steps of the cash deposit processing process are described as follows.

In S100, a virtual electronic banknote box and a banknote box information table are read from a banknote box information memory by the main control unit, and stored in a memory which the main control unit itself has.

In S101, the attribute of the banknote box in the banknote box information table in the banknote box information memory is preset to be unbelievable.

Presetting the attribute of the banknote box in the banknote box information memory to be the unbelievable status is done in order to prevent the information about the virtual electronic banknote box and about the banknote box information table in the banknote box information memory from not being updated due to interruption of power supply during cash deposit, otherwise the banknote box is regarded as a believable banknote box and is provided into an automatic banknote adding system, causing that the automatic banknote adding system cannot operate properly.

During the cash deposit, operations related to the virtual electronic banknote box and to the banknote box information table are performed in the main control unit. Before the cash deposit ends, the virtual electronic banknote box and the banknote box information table in the banknote box information memory are used for backup and are not changed.

In S102, it is judged whether the cash deposit is over or not. If the cash deposit is over, step S113 is performed; and if the cash deposit is not over, step S103 is performed.

In S103, the Nth banknote is stored.

Specifically, when the Nth banknote enters into the transport channel, the identification unit detects the Nth banknote to obtain the inherent information on the Nth banknote and verifies whether the Nth banknote is qualified or not. The main control unit reads from the identification unit the verification result whether the banknote is qualified or not. If the banknote is qualified, the Nth banknote is transported to a target banknote box (i.e. a physical banknote box for storing the Nth banknote); and if the banknote is not qualified, the cash deposit is stopped and all of the banknotes in the transport channel are withdrawn.

In S104, it is judged whether the attribute of the target banknote box is believable or not. If the attribute of the target banknote box is believable, step S106 is performed; and if the attribute of the target banknote box is not believable, step S105 is performed.

In S105, the Nth banknote is stored in a store-only banknote box, and 1 is added to N, and then the process returns back to S102. Here, the store-only banknote box indicates a banknote box which is used only for storing banknotes and not for withdrawing banknotes.

In S106, before the Nth banknote reaches the entrance of the target banknote box, it is detected whether the status of the Nth banknote during the transportation is abnormal or not. If the status of the Nth banknote during the transportation is abnormal, step S105 is performed; and if the status of the Nth banknote during the transportation is not abnormal, step S107 is performed.

In S107, the Nth banknote is continuously transported to the target banknote box, and when the Nth banknote moves to the entrance of the target banknote box, it is detected again whether the status of the Nth banknote is abnormal or not. If the status of the Nth banknote is abnormal, step S109 is performed; and if the status of the Nth banknote is not abnormal, step S108 is performed.

In S108, the inherent information on the Nth banknote is recorded in the virtual electronic banknote box in the main control unit, and 1 is added to the primary pointer and the secondary pointer.

In S109, the cash deposit is stopped, all the banknotes in the transport channel are withdrawn, and step S110, S111 or S112 is performed.

In S110, if a terminal machine receiving the deposit is a cash recycling ATM, the attribute of the banknote box is set to be unbelievable, and cash deposit is not allowed into the banknote box before a banknote-output correction succeeds.

In S111, if a terminal machine receiving the deposit is a cash deposit ATM, the attribute of the banknote box is set to be unavailable, and it is not allowed to automatically add a banknote.

In S112, if a terminal machine receiving the deposit is a banknote adding machine, the attribute of the banknote box is set to be unavailable, and it is needed to add a banknote again.

In S113, the cash deposit ends.

The same processing is carried out as described above for the other banknotes of the same cash deposit, until the processing for all of the banknotes ends.

Moreover, after the cash deposit ends, the process also includes the following steps.

In S114, each of the channel sensors and the banknote box entrance sensors is checked. If the checking is failure, the attribute of the banknote box is set to be unbelievable. It is no longer allowed to make cash deposit into the banknote box which is set to be unbelievable. The cash deposit in this banknote box may continue only if the attribute of the banknote box is converted to be believable by correction of outputting the banknotes.

In S115, the main control unit downloads the updated virtual electronic banknote box and banknote box information table to the banknote box information memory so as to update corresponding information in the banknote box information memory.

Figure 6:
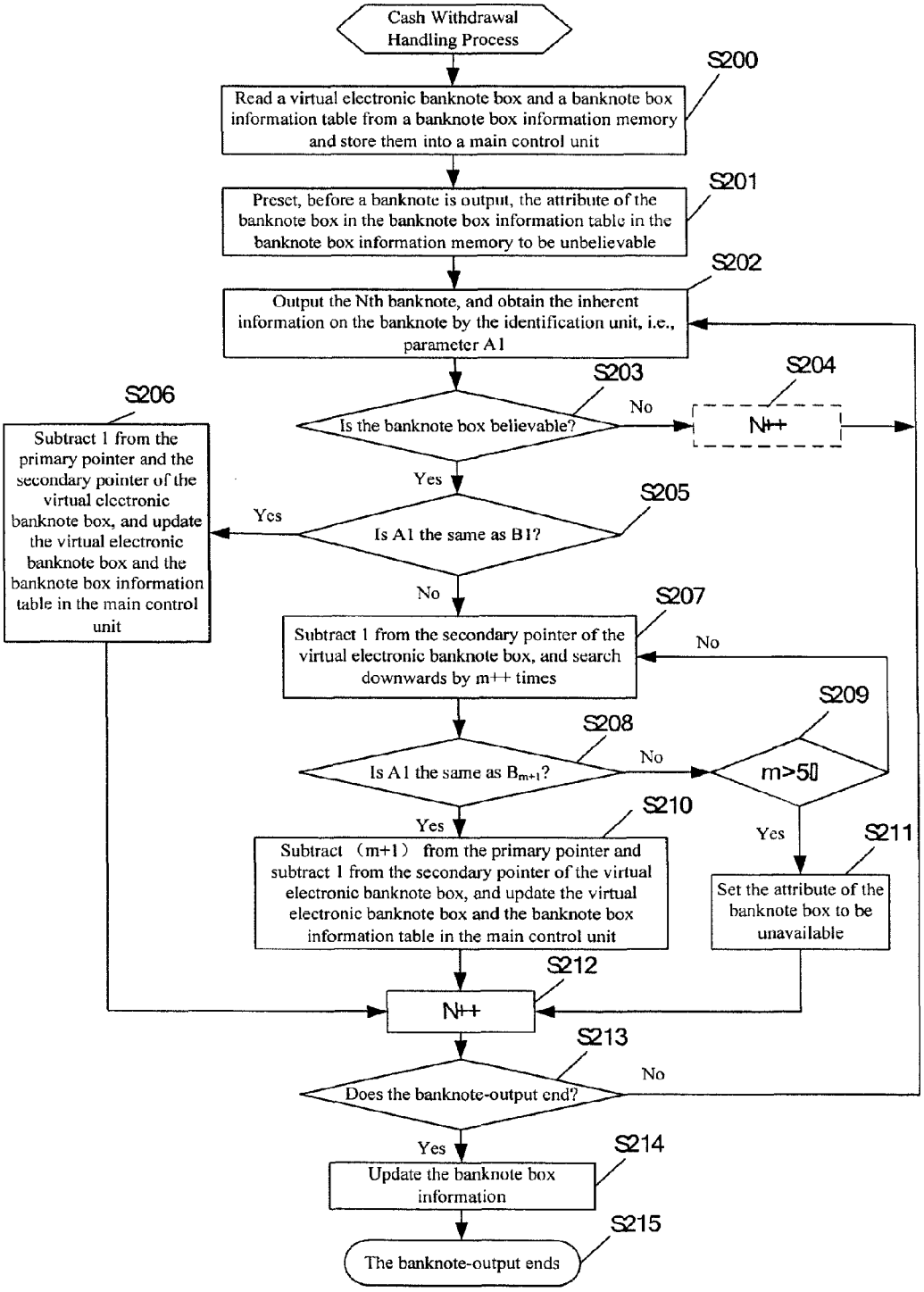
FIG. 6 is a schematic flowchart of a cash withdrawal processing process according to an embodiment of the present invention.

Reference is made to FIG. 6, which is a schematic flowchart of a cash withdrawal processing process according to an embodiment of the present invention.

During the cash withdrawal, the virtual electronic banknote box and the physical banknote box operate synchronously, and verify and correct with each other, so as to guarantee the accuracy of the information on the banknotes in the physical banknote box.

As shown in FIG. 6, the specific implementation steps of the cash withdrawal processing process are described as follows.

In S200, a virtual electronic banknote box and a banknote box information table are read from a banknote box information memory and stored in a memory which the main control unit itself has.

In S201, before a banknote is output, the attribute of the banknote box in the banknote box information table in the banknote box information memory is preset to be unbelievable. Similarly, presetting the attribute of the banknote box in the banknote box information memory to be unbelievable is done in order to avoid an unbelievable or unavailable banknote box from being supplied into the automatic banknote adding system. Moreover, during the cash withdrawal, operations related to the virtual electronic banknote box and to the banknote box information table are performed in the main control unit. Before the cash withdrawal ends, the virtual electronic banknote box and the banknote box information table in the banknote box information memory are used for backup and are not changed.

In S202, the Nth banknote is output, and when the banknote passes through the banknote output identification channel, the identification unit obtains the inherent information on the Nth banknote. The inherent information is designated as parameter A1 for checking the output banknote.

In S203, it is judged whether the attribute of the banknote box for the Nth banknote before being output is believable or not. If so, step S205 is performed; and if not, step S204 is performed.

In S204 which is an optional step, a banknote may be selected to be continuously output from this banknote box. However, banknotes cannot be automatically added into this banknote box.

In S205, provided that the inherent information currently pointed by the primary pointer is designated as parameter B1, it is judged whether parameter A1 is the same as parameter B1 or not. If so, step S206 is performed; and if not, step S207 is performed.

In S206, 1 is subtracted from the primary pointer and the secondary pointer of the virtual electronic banknote box; and the virtual electronic banknote box and the banknote box information table in the main control unit are updated, i.e. parameter B1 in the virtual electronic banknote box is deleted; the attribute of the physical banknote box in the banknote box information table is set in a believable status; and the information in the banknote box information table such as the number of the banknotes and the face values of the banknotes is updated.

In S207, 1 is subtracted from the secondary pointer of the virtual electronic banknote box, and inherent information which is the same as parameter A1 is searched towards the previously stored inherent information in the virtual electronic banknote box; and provided that the number of times 1 has been subtracted from the secondary pointer in order to search for the inherent information is designated as m, 1 is added to m (i.e., m++).

In S208, it is judged whether parameter A1 is the same as parameter $B_{(m+1)}$ or not. If so, step S211 is performed; and if not, step S209 is performed.

In S209, it is judged whether or not m is larger than 5 (here, it is assumed that the preset threshold of the number of searching times is 5). If so, step S211 is performed; and if not, the process returns back to step S207.

In S211, if there is a severe problem in the banknote box, the attribute of the banknote box is set to be unavailable.

In S210, (m+1) is subtracted from the primary pointer of the virtual electronic banknote box and 1 is subtracted again from the secondary pointer of the virtual electronic banknote box; and the virtual electronic banknote box and the banknote box information table in the main control unit are updated. In a specific implementation, it is possible to determine the face values and the number of the banknotes residual in the physical banknote box from the inherent information in the virtual electronic banknote box and the position pointed by the primary pointer, is determined, and the banknote box information table in the main control unit is also updated.

More specifically, in steps S206 to S211 described above, if parameter A1 is not the same as parameter B1, 1 is subtracted from the secondary pointer of the virtual electronic banknote box. Provided that the inherent information on the banknote pointed by the secondary pointer is designated as parameter B2, parameter B2 is compared with parameter A1. If parameter A1 is the same as parameter B2, 2 is subtracted from the primary pointer of the virtual electronic banknote box and 2 is subtract from the number of the banknotes in the banknote box. If parameter A1 is not the same as parameter B2, 1 is subtracted again from the secondary pointer of the virtual electronic banknote box. Provided that the inherent information on the banknote pointed by the secondary pointer is designated as parameter B3, parameter B3 is compared with parameter A1. If parameter B3 is still not the same as parameter A1, 1 is subtracted again from the secondary pointer of the virtual electronic banknote box, and the search goes on downwards. If the search goes on to parameter B6 and parameter B6 is still not the same as parameter A1, this shows that there is severe non-correspondence between the physical banknote box and the virtual electronic banknote box, and the attribute of the corresponding banknote box is recorded to be unavailable in the main control unit. Banknotes cannot be automatically added into a banknote box with the unavailable attribute, and the cash deposit cannot be performed with respect to the banknote box with the unavailable attribute, but the banknote box with the unavailable attribute can be selected to go on outputting the banknotes.

In S212, add 1 to N, and wait for the next banknote to be output.

The same processing is carried out as described above for the other banknotes of the same cash withdrawal, until all of the banknotes are output. In a specific implementation, according to the status of the last output banknote, processing is performed in two ways. Firstly, if the banknote is in an abnormal status, the banknote is retracted; the present transaction ends; and the attribute of the corresponding banknote box is recorded to be unbelievable in the main control unit. Secondly, if the banknote is in a normal status, the attribute of the corresponding banknote box is recorded to be believable in the main control unit.

In S213, it is judged whether the banknote-output ends or not. If so, step S214 is performed; and if not, the process returns back to step S202.

In S214, the virtual electronic banknote box and the banknote box information table in the banknote box information memory are updated according to the operation result of the main control unit.

In S215, the banknote-output ends.

It should be noted that all the steps of the banknote processing method described above may be achieved with the banknote processing system according to the embodiments of the present invention. The cash deposit processing process and the cash withdrawal processing process in the banknote processing system according to the embodiments of the present invention are the same as that in the above mentioned embodiments, which will not be described in detail any more.

In the banknote processing system and method according to the embodiments of the present invention, the virtual electronic banknote box which has one-to-one mapping relationship with the banknotes in the physical banknote box is established. When a banknote is input into or output from the physical banknote box, the inherent information in the virtual electronic banknote box is synchronously updated. Thus, the information on the banknotes in the physical banknote box may be determined from the information in the virtual electronic banknote box. Therefore, the accurate flow of the banknotes in the physical banknote box is ensured, and the information on the banknotes in the physical banknote box is guaranteed to be accurate, which may provide accurate banknote box information to the automatic banknote adding system.

It may be understood by the skilled in the art that all or a part of the process in the method according to the embodiments described above may be implemented by a computer program instructing related hardware. The program may be stored in a computer readable storage media. When the program is executed, the process of the embodiments of each method mentioned above may be included. The storage media may be a magnetic disc, an optical disc, a Read-Only Memory (ROM) or a Random Access Memory (RAM) and so on.

The above description relates to the preferred embodiments of the present invention. It should be pointed out that, for the skilled in the art, some improvements and modifications may be made without departing from the principle of the present invention, and these improvements and modifications are also deemed to fall in the scope of protection of the present invention.

What is claimed is:

1. A banknote processing system, comprising a terminal machine, an identification unit, a physical banknote box, a banknote box information memory and a main control unit, wherein:

the terminal machine is configured to deal with a cash deposit transaction and/or a cash withdrawal transaction;

the identification unit is configured to, during the cash deposit transaction or the cash withdrawal transaction via the terminal machine, detect a banknote which is input into or output from the physical banknote box to get inherent information on the banknote, the inherent information is identification information for distinguishing various banknotes;

the physical banknote box is configured to store banknotes;

the banknote box information memory is configured to:

store a virtual electronic banknote box, the virtual electronic banknote box is an aggregate of the inherent information on banknotes, the inherent information in the virtual electronic banknote box and banknotes in the physical banknote box have a one-to-one mapping relationship with each other, and a storage order of the inherent information and a stacking order of the banknotes in the physical banknote box are equal; and store a banknote box information table which comprises physical banknote box information on an attribute of the physical banknote box, wherein the attribute comprises at least one of a believable status, an unbelievable status, and an unavailable status, and wherein the believable status represents that the inherent information in the virtual electronic banknote box and the banknotes in the physical banknote box have the one-to-one mapping relationship with each other; the unbelievable status represents that there is dislocation in a mapping relationship between the virtual electronic banknote box and the physical banknote box, and correction of outputting the banknotes is needed; and the unavailable status represents that there is a severe error in the mapping relationship between the virtual electronic banknote box and the physical banknote box, and automatic correction is not available; and the main control unit is configured to update the virtual electronic banknote box according to the inherent information on the banknote obtained by the identification unit; and to determine information on the banknotes in the physical banknote box according to the inherent information in the virtual electronic banknote box.

2. The banknote processing system according to claim 1, wherein:

the information is further on a number of the banknotes in the physical banknote box and face values of the banknotes in the physical banknote box; and both the physical banknote box and the virtual electronic banknote box are in a first-in last-out stack mode, and the main control unit uses a primary pointer and a secondary pointer to track the inherent information in the virtual electronic banknote box; and during initialization, the primary pointer and the secondary pointer point to a stack top of the virtual electronic banknote box.

3. The banknote processing system according to claim 2, wherein:

the identification unit is further configured to verify whether a banknote to be going into the physical banknote box is qualified, and to transmit a verification result to the main control unit, and the main control unit comprises:

an information reading module configured to read the virtual electronic banknote box and the banknote box information table from the banknote box information memory;

a banknote-input processing module configured to, if it is determined from the verification result that the banknote to be going into the physical banknote box is qualified, store the banknote in the physical banknote box, and store sequentially inherent information on the banknote into the virtual electronic banknote box, and add 1 to the primary pointer and the secondary pointer of the virtual electronic banknote box;

a banknote-output processing module configured to compare inherent information on a banknote which is output from the physical banknote box with the inherent information in the virtual electronic banknote box, so as to search for a mapped position of the banknote in the virtual electronic banknote box and to delete the inherent information at the mapped position;

a banknote box information processing module configured to determine the number of the banknotes in the physical banknote box according to a position pointed by the primary pointer of the virtual electronic banknote box; and to determine the face values of the banknotes in the physical banknote box according to the inherent information in the virtual electronic banknote box; and a banknote box information updating module configured to update, after the cash deposit transaction or the cash withdrawal transaction ends, the inherent information in the virtual electronic banknote box and the banknote box information table which are in the banknote box information memory.

4. A banknote processing method, comprising the steps of:

S1: detecting a banknote which is input into or output from a physical banknote box to obtain inherent information on the banknote; and updating a virtual electronic banknote box according to the inherent information on the banknote, wherein the inherent information is identification information for distinguishing various banknotes; the virtual electronic banknote box is an aggregate of the inherent information on banknotes, the inherent information in the virtual electronic banknote box and banknotes in the physical banknote box have a one-to-one mapping relationship with each other, and a storage order of the inherent information and a stacking order of the banknotes in the physical banknote box are equal, wherein the virtual electronic banknote box is stored in a banknote box information memory, and the banknote box information memory is further configured to store a banknote box information table which comprises physical banknote box information on an attribute of the physical banknote box and wherein the attribute comprises at least one of a believable status, an unbelievable status, and an unavailable status; and S2: determining information on the banknote in the physical banknote box according to the inherent information in the virtual electronic banknote box.

5. The banknote processing method according to claim 4, wherein:

the physical banknote box information is further on a number of the banknotes in the physical banknote box and face values of the banknotes in the physical banknote box; and both the physical banknote box and the virtual electronic banknote box are in a first-in last-out stack mode, and a main control unit uses a primary pointer and a secondary pointer to track the inherent information in the virtual electronic banknote box; and during initialization, the primary pointer and the secondary pointer point to a stack top of the virtual electronic banknote box.

6. The banknote processing method according to claim 5, wherein, during a cash deposit transaction, step S1 comprises:

C0: reading, by the main control unit, the virtual electronic banknote box and the banknote box information table from the banknote box information memory;

C1: detecting, by an identification unit, a banknote to be input into the physical banknote box to obtain inherent information on the banknote;

C2: the identification unit verifying whether the banknote is qualified, and sending a verification result to the main control unit; and C3: if it is determined by the main control unit from the verification result that the banknote is qualified, storing the banknote in the physical banknote box; storing sequentially the inherent information on the banknote into the virtual electronic banknote box; and adding 1 to the primary pointer and to the secondary pointer.

7. The banknote processing method according to claim 5, wherein, during a cash withdrawal transaction, step S1 comprises:

D0: reading, by the main control unit, the virtual electronic banknote box and the banknote box information table from the banknote box information memory;

D1: detecting, by the identification unit, a banknote which is output from the physical banknote box to obtain inherent information on the banknote; and D2: comparing, by the main control unit, the inherent information on the banknote with the inherent information in the virtual electronic banknote box, so as to search for a mapped position of the banknote in the virtual electronic banknote box and to delete the inherent information at the mapped position.

8. The banknote processing method according to claim 7, wherein the inherent information on the banknote obtained in step D1 is designated as parameter A1, the inherent information currently pointed by the primary pointer of the virtual electronic banknote box is designated as parameter B1, and step D2 comprises:

D21: judging whether the parameter A1 is equal to the parameter B1;

if so, subtracting 1 from the primary pointer and from the secondary pointer, deleting the parameter B1, and setting the attribute of the physical banknote box to be the believable status; and if not, subtracting 1 from the secondary pointer, and searching downwards towards a stack bottom of the virtual electronic banknote box for inherent information which is equal to the parameter A1; and designating the inherent information pointed by the secondary pointer from which 1 has been subtracted as parameter B2, and performing step D22;

D22: judging whether the parameter A1 is the same as the parameter B2;

if so, subtracting 2 from the primary pointer and subtracting 1 again from the secondary pointer, and setting the attribute of the physical banknote box to be the unbelievable status; and if not, subtracting 1 again from the secondary pointer and continuously searching downwards for the inherent information which is equal to the parameter A1;

D23: judging whether m, which is designated as the number of times 1 has been subtracted from the secondary pointer in order to search for the inherent information, is larger than a preset threshold of number of searching times;

if so, setting the attribute of the physical banknote box to be the unavailable status; and if not, subtracting (m+1) from the primary pointer and subtracting 1 again from the secondary pointer, and setting the attribute of the physical banknote box to be the unbelievable status.

9. The banknote processing method according to claim 8, wherein the information described in step S2 comprises information on the number of the banknotes in the physical banknote box and the face values of the banknotes in the physical banknote box; and step S2 comprises:

determining the number of the banknotes in the physical banknote box according to a position pointed by the primary pointer of the virtual electronic banknote box; and determining the face values of the banknotes in the physical banknote box according to the inherent information in the virtual electronic banknote box.

10. The banknote processing method according to claim 9, wherein, after step S2, the method further comprises the step of:

S3: updating, after the cash deposit transaction or the cash withdrawal transaction ends, the inherent information in the virtual electronic banknote box and the banknote box information table which are in the banknote box information memory.

11. The banknote processing method according to claim 6, wherein, during the cash withdrawal transaction, step S1 comprises:

D0: reading, by the main control unit, the virtual electronic banknote box and the banknote box information table from the banknote box information memory;

D1: detecting, by the identification unit, a banknote which is output from the physical banknote box to obtain inherent information on the banknote; and D2: comparing, by the main control unit, the inherent information on the banknote with the inherent information in the virtual electronic banknote box, so as to search for a mapped position of the banknote in the virtual electronic banknote box and to delete the inherent information at the mapped position.

12. The banknote processing method according to claim 11, wherein the inherent information on the banknote obtained in step D1 is designated as parameter A1, the inherent information currently pointed by the primary pointer of the virtual electronic banknote box is designated as parameter B1, and step D2 comprises:

D21: judging whether the parameter A1 is equal to the parameter B1;

if so, subtracting 1 from the primary pointer and from the secondary pointer, deleting the parameter B1, and setting the attribute of the physical banknote box to be the believable status; and if not, subtracting 1 from the secondary pointer, and searching downwards towards a stack bottom of the virtual electronic banknote box for inherent information which is equal to the parameter A1; and designating the inherent information pointed by the secondary pointer from which 1 has been subtracted as parameter B2, and performing step D22;

D22: judging whether the parameter A1 is the same as the parameter B2;

if so, subtracting 2 from the primary pointer and subtracting 1 again from the secondary pointer, and setting the attribute of the physical banknote box to be the unbelievable status; and if not, subtracting 1 again from the secondary pointer and continuously searching downwards for the inherent information which is equal to the parameter A1;

D23: judging whether m, which is designated as the number of times 1 has been subtracted from the secondary pointer in order to search for the inherent information, is larger than a preset threshold of number of searching times;

if so, setting the attribute of the physical banknote box to be the unavailable status; and if not, subtracting (m+1) from the primary pointer and subtracting 1 again from the secondary pointer, and setting the attribute of the physical banknote box to be the unbelievable status;

wherein the believable status represents that the inherent information in the virtual electronic banknote box and the banknotes in the physical banknote box have a one-to-one mapping relationship with each other, and correction of outputting the banknotes is not needed; the unbelievable status represents that there is dislocation in a mapping relationship between the virtual electronic banknote box and the physical banknote box, and the correction of outputting the banknotes is needed; and the unavailable status represents that there is a severe error in the mapping relationship between the virtual electronic banknote box and the physical banknote box, and automatic correction is not available.

13. The banknote processing method according to claim 12, wherein the information described in step S2 comprises information on the number of the banknotes in the physical banknote box and the face values of the banknotes in the physical banknote box; and step S2 comprises:

determining the number of the banknotes in the physical banknote box according to a position pointed by the primary pointer of the virtual electronic banknote box; and determining the face values of the banknotes in the physical banknote box according to the inherent information in the virtual electronic banknote box.

14. The banknote processing method according to claim 13, wherein, after step S2, the method further comprises the step of:

S3: updating, after the cash deposit transaction or the cash withdrawal transaction ends, the information in the virtual electronic banknote box and the banknote box information table which are in the banknote box information memory.

* * * * *